US005314026A

United States Patent [19]

Williamson, Jr.

[11] Patent Number: 5,314,026

[45] Date of Patent: May 24, 1994

[54] LANDING NIPPLE

[75] Inventor: Jimmie R. Williamson, Jr., Carrollton, Tex.

[73] Assignee: Otis Engineering Corporation, Carrollton, Tex.

[21] Appl. No.: 846,795

[22] Filed: Mar. 4, 1992

[51] Int. Cl.[5] ..... E21B 34/14; E21B 34/10

[52] U.S. Cl. ..... 166/386; 166/72; 166/242; 166/317; 166/319; 166/322; 166/330

[58] Field of Search ..... 166/242, 72, 330, 322, 166/318, 317, 386, 373, 319

[56] References Cited

U.S. PATENT DOCUMENTS

| | | | |
|---|---|---|---|
| 1,629,058 | 5/1927 | Wilson | 285/391 |
| 1,896,104 | 2/1933 | Simmons | 166/242 |
| 2,675,874 | 4/1954 | Springer | 166/330 X |
| 3,152,646 | 10/1964 | Burns | 166/330 |
| 3,442,536 | 5/1969 | Fowler | 285/27 |
| 3,625,283 | 12/1971 | Ahlstone | 166/330 X |
| 3,799,258 | 3/1974 | Tausch | 166/322 X |
| 3,882,935 | 5/1975 | Calhoun | 166/322 |
| 4,249,599 | 2/1981 | Krause | 166/72 |
| 4,273,186 | 6/1981 | Pearce et al. | 166/72 |
| 4,294,315 | 10/1981 | Yonker et al. | 166/322 |
| 4,460,046 | 7/1984 | Pringle | 166/317 |
| 4,534,414 | 8/1985 | Pringle | 166/317 |
| 4,566,540 | 1/1986 | Pringle et al. | 166/317 |
| 4,660,647 | 4/1987 | Richart | 166/72 X |
| 4,721,162 | 1/1988 | Pringle et al. | 166/319 |
| 4,890,674 | 1/1990 | Le | 166/319 |
| 4,944,351 | 7/1990 | Eriksen et al. | 166/317 |
| 4,981,177 | 1/1991 | Carmody et al. | 166/376 |
| 5,012,867 | 5/1991 | Kilgore | 166/188 |
| 5,082,061 | 1/1992 | Dollison | 166/378 |
| 5,095,994 | 3/1992 | Dollison | 166/386 |

*Primary Examiner*—Hoang C. Dang
*Attorney, Agent, or Firm*—Jennifer R. Daunis

[57] ABSTRACT

A safety valve landing nipple selectively provides a pin for closing communication in the bore between the first control line and the safety valve control line so that communication between the first control line and an insert safety valve in the landing nipple housing is achieved by use of a rotary member. A rotary shifting tool is used to rotate the rotary member so that a cam sleeve pushes a poppet pin to form a metal to metal seal with a fitting adaptor connecting the first control line and the safety valve control line so as to provide communication between the surface control line and the internal bore of the landing nipple. A method of closing communication within a safety valve landing nipple between a first control line and a safety valve control line and opening communication between said first control line and an insert safety valve by use of a rotary shifter assembly to rotate a rotary member an amount sufficient to push a poppet pin to form a metal to metal seal to close communication between a first control line and a safety valve control line and open communication between the first control line and the insert safety valve.

49 Claims, 6 Drawing Sheets

LANDING NIPPLE

BACKGROUND OF THE INVENTION

A. Field of the Invention

This invention relates to a safety valve landing nipple. More particularly, this invention relates to a safety valve landing nipple which redirects control line fluid flow by rotation of a rotary sleeve and the formation of a metal to metal seal with a valve poppet so as to close communication between a first control line and a safety valve control line so as to achieve communication between the first control line and a second safety valve which may be an insert safety valve.

B. The Prior Art

U.S. Pat. No. 4,294,315 discloses a landing nipple adaptable to be made up in a tubing string having a sliding sleeve disposed in its bore for selectively providing communication of balance and control pressure fluid to the nipple bore. Upon seal failure, the fluid invades the balance pressure fluid communication means instead of the control pressure fluid communication means.

U.S. Pat. No. 4,273,186 discloses a well safety system comprising a tubing retrievable safety valve and landing nipple which are connected by a common conduit for conducting a suitable pressure fluid for control and balance of the safety valve and a secondary valve landed in the landing nipple. Either the safety valve or the landing nipple may be selected for the control or balance fluids to flow into.

U.S. Pat. No. 4,566,540 discloses a hydraulic actuated communication nipple for switching control fluid from one location to a second location in a well tool. A ball is dropped down the control line and seats on the piston, closing the fluid passage, moving the sleeve, and opening the fluid passageway to the bore. The piston also acts as a vertical moving plug to seal off the outlet with a metal to metal seal.

U.S. Pat. No. 4,981,177 discloses a downhole tool which may be a safety valve or stand alone nipple. A cutting tool is mounted for radially movement in a recess provided in the internal bore of the tubular housing. The control pipe is severed by the cutting tool and the severed portion of the pipe is crimped closed.

U.S. Pat. No. 4,721,162 discloses a well safety valve for use in a fluid well conduit through which fluid is produced by pumping. A valve opens and closes in response to the fluid level in the conduit. When pumping is discontinued, the fluid level in the conduit increases to a predetermined high level to close the valve. When pumping begins, the fluid level falls and when it reaches a predetermined low level the valve is opened.

U.S. Pat. No. 4,890,674 discloses a subsurface safety valve with a flapper plate and operator tube where the operator tube telescopically retracts within the piston while the flapper plate rotates through the critical throttling region into sealing engagement against the flapper valve seat. The operator tube is retracted rapidly through the spring housing in response to rotation of the flapper plate, thus substantially reducing the magnitude of reaction forces which arise during dragging engagement between the flapper plate and the curved edge of the operator tube.

U.S. Pat. Nos. 1,629,058, 3,442,536 and 1,896,104 show known rotary locking systems but do not relate to a rotary landing nipple and rotary shifter.

U.S. Pat. No. 5,082,061 and U.S. Pat. No. 5,141,023, both assigned to Otis Engineering Corporation for Rotary Locking System with Metal Seals and Flow Actuated Safety Valve with Retrievable Choke and Metal Seals, respectively, are relevant.

U.S. Pat. No. 4,082,061 discloses a landing nipple connectible in a well conduit. The landing nipple has an internal metal seat and helically profiled segments with upper orienting surfaces. A well flow control device is connected to a rotary lock mandrel, which is connected to a rotary running tool and lowered into the well conduit and landing nipple. Repeated downward impact on the running tool rotates the rotary lock mandrel and segments into locking engagement with the landing nipple segments, sealingly engaging the lock mandrel metal seal surface with the landing nipple metal seat.

U.S. Pat. No. 5,141,023 discloses a direct acting safety valve having a flapper valve, all metal to metal seals, and a retrievable flow choke carried on a lock mandrel, which locks and seals in the safety valve operating tube. Production flow impingement force on the flow choke overcomes the force of a roller type snap closure device and a spring holding the operating tube in valve open position, releasing the operating tube to move upward quickly to a position permitting the flapper valve to close.

U.S. Pat. No. 4,460,046 discloses a control fluid communication nipple with a vertically moving sleeve which breaks a screw in tension and exposes the cavity in the screw to the interior of the well tool.

U.S. Pat. No. 4,566,540 discloses a hydraulically actuated control fluid communication nipple with a vertically moving sleeve which opens the fluid passageway to the bore when a ball is dropped down the control line, seats on the piston and closes the fluid passage.

U.S. Pat. No. 5,012,867 discloses a Well flow control system in a well conduit including a landing nipple.

The use of a longitudinal or vertically moving shifting means is not sufficient to prevent premature lockout because unintended shifting can easily take place. However, it is unlikely that standard wireline tools can provide enough torque to unintentionally rotate a rotary member. Thus, a landing nipple with a rotary member used to selectively close communication between a first control line and a safety valve control line and open communication between the first control line and an insert safety valve is needed so that premature lockout is prevented.

SUMMARY OF THE INVENTION

The present invention encompasses a landing nipple comprising a nipple profile sub, a landing nipple housing connected to the nipple profile sub, a rotary member positioned inside the nipple profile sub, wherein the rotary member contains at least one slot or protrusion therein for engagement by one or more lugs of a rotary shifter, a bore in the wall of the nipple profile sub, to which is connected a first control line on one end and a safety valve control line on the other end, and a means for closing communication in said bore between the first control line and the safety valve control line by forming a metal to metal seal so that communication between the first control line and an insert safety valve in the landing nipple housing is achieved. The nipple also contain a means for guiding the rotary shifter. Preferably the means for closing communication comprises a pin positioned in the bore and a means for moving the pin, preferably a cam sleeve, to form a metal to metal seal.

Also encompassed herein is a method of closing communication within the landing nipple between the first control line and a safety valve control line and opening communication between the first control line and an insert safety valve which comprises the steps of placing a means for rotation within a nipple profile sub and rotary member and rotating said rotary member an amount sufficient to cause a means for closing communication between said surface control line and said safety valve control line to move in such a way to form a metal to metal seal with a means for connecting the first control line and the safety valve control line so as to open communication between said first control line and said insert safety valve.

DETAILED DESCRIPTION OF THE INVENTION

Figure 1:
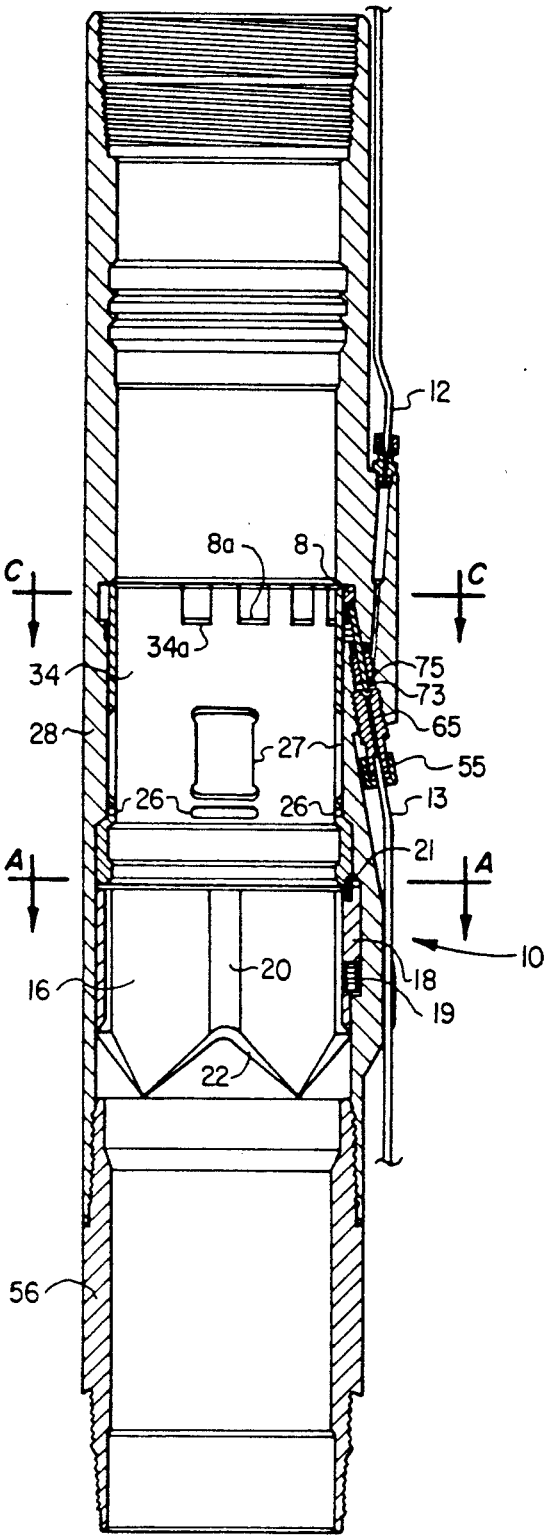
FIG. 1 is an elevational view in cross section of the landing nipple of the invention.

FIG. 1 shows a landing nipple 10 with control line 12 to the well surface control manifold. Landing nipple 10 is rotary operated as will be explained. Control line 13 leads to the surface controlled subsurface safety valve (SCSSV). Landing nipple 10 is made up of a nipple profile sub 28 which is threaded to landing nipple housing 56.

A rotary member is positioned inside nipple profile sub 28 and contains a means for engagement by a means for rotating the rotary member. Preferably the rotary member is a rotary sleeve 34, although it could also be a partial sleeve, a "C" shaped member or a rectangular shaped member. Rotary member may be retained in a longitudinal direction so that the rotary member can rotate but not slide or move in a longitudinal direction Preferably the means for engagement is one or more slots 26 and extended slots 27. Preferably the means for rotating the rotary member is a rotary shifter assembly 24, further discussed herein.

Referring again to FIG. 1, rotary sleeve 34 is provided with one or more slots 26 and extended slots 27 and is positioned inside nipple profile sub 28. Slots 26 and 27 are provided in sleeve 34 for engagement by one or more keys 30 of a rotary shifter assembly 24, as discussed further below. Slots 26 and extended slots 27 are present in the preferred embodiment of this invention but are not necessarily required. Rotary sleeve 34 contains slots 26 and extended slots 27 which are held in radial alignment with slot 20 in guide sleeve 16. Because of the narrow width of slots 26, extended slots 27 and slot 20 and the spacing of the 45 degree angles at each end, only a unique shifter assembly 24 can be used to provide the unique selective communication of this invention, thus avoiding accidental shifting.

Rotary sleeve 34 is also provided with a means for attachment to a cam sleeve 8, which is preferably one or more cam sleeve slots **8*a*, preferably a plurality of slots 8*a*, as shown in FIG. 1**.

An optional means for guiding rotary shifter 24 into engagement with rotary sleeve 34, preferably guide shoe 16, may be positioned inside nipple profile sub 28, contiguous to sleeve 34. Rectangular key 18 is positioned in the housing of nipple profile sub 28 and guide shoe 16. Key 18 holds stationary slot 20 and orienting slots 22 in guide shoe 16 in the desired position. Compression spring 19 applies an upward acting force on key 18 and a downward force on guide shoe 16.

Guide shoe 16 is provided with orienting slots 22 which assist in positioning or orienting rotary shifter assembly 24 along stationary slot 20. Guide shoe 16 is not necessary to this invention but represents the preferred embodiment.

Figure 2:
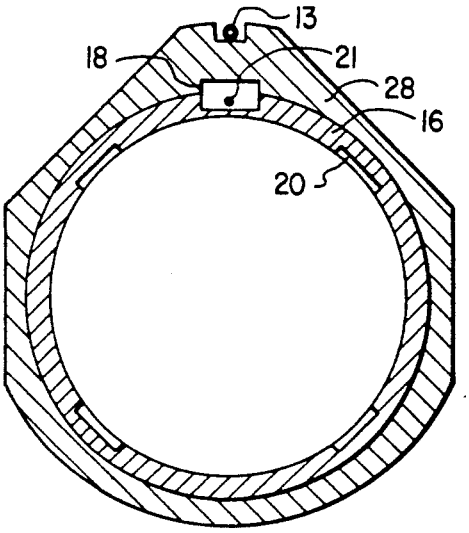
FIG. 2 is a cross sectional view of the landing nipple of the invention taken along line A—A of FIG. 1.

FIG. 2 shows a cross-sectional view of FIG. 1 taken along line A—A which shows nipple profile sub 28 and guide shoe 16 before sleeve 34 has been rotated. Rectangular key 18 is shown with shear pin 21 and stationary slots 20.

Figure 3:
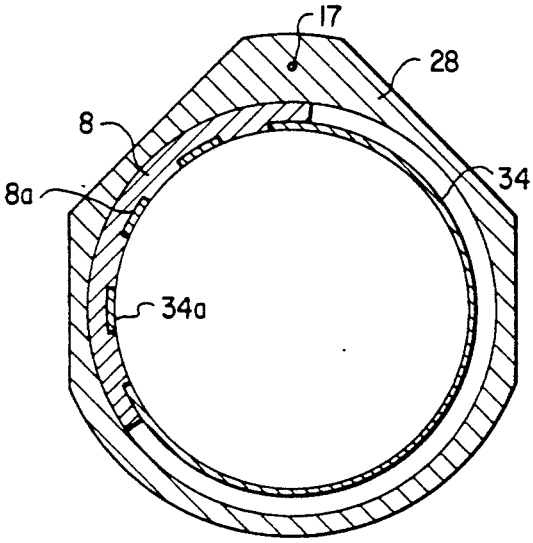
FIG. 3 is a cross sectional view of the landing nipple of the invention showing the same sleeve taken along line C—C of FIG. 1.

FIG. 3 shows a cross-sectional view of FIG. 1 taken along line C—C which shows nipple profile sub 28, sleeve 34, and cam sleeve 8 before rotation. One or more cam sleeve slots **8*a* are placed preferably on one side of sleeve 34 so as to engage with sleeve slots 34*a***.

Figure 5:
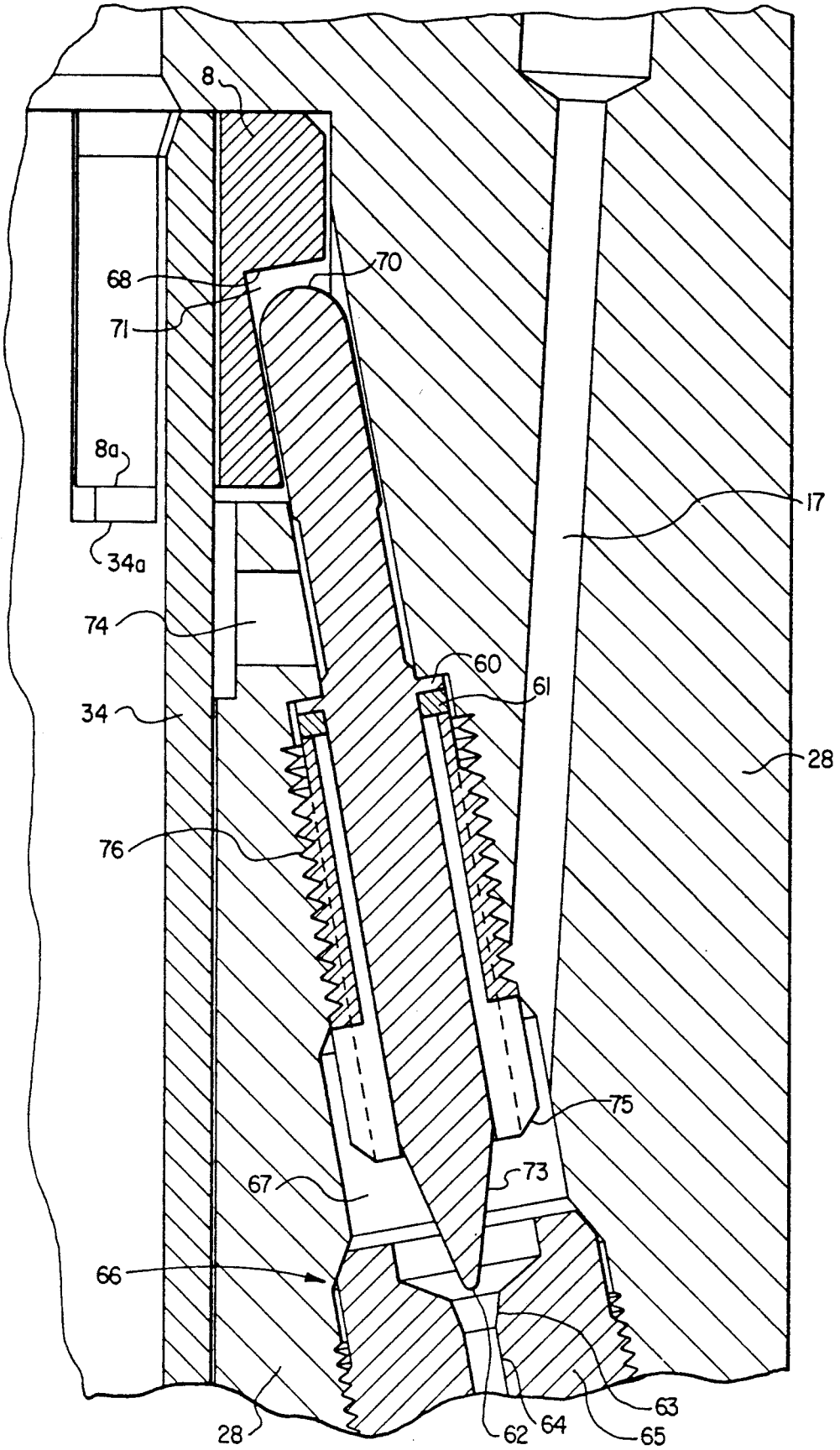
FIG. 5 is an enlarged cross sectional view of the means for closing communication between the first control line and safety valve control line in the position closed to the insert safety valve within the landing nipple.

FIG. 5 shows an enlarged detailed view of the landing nipple in the closed position. Rotary sleeve 34 is attached to cam sleeve 8. Bore 17 is provided through nipple profile sub housing 28 through which valve poppet 73 is positioned. Poppet 73 may be partially surrounded by retainer 75 which is in turn provided with threads 76. Valve poppet 73 is provided with shearable flange 60. Washer 61 is placed between shearable flange 60 and retainer 75. Any suitable means for closing communication in bore 17 between first control line 12 and safety valve control line 13 may be used. Poppet 73 is merely the preferred embodiment of this invention. Other suitable means include the use of a spherical ball and seat or an elastomeric face seal.

As sleeve 34 is rotated, cam sleeve 8 rotates as well. Cam sleeve 8 is angled in such a way that upon sufficient rotation, cam sleeve 8 contacts and pushes against surface 70 of poppet 73 with sufficient force so that flange 60 is sheared, valve poppet 73 is pushed further into bore 64 against fitting adapter 65 and tip 62 is forced into internal bore 64 of fitting adapter 65.

Figure 4:
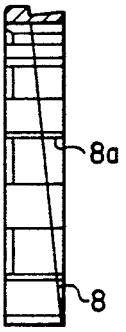
FIG. 4 is an elevational view in cross section of the cam sleeve shown in FIG. 3.
Figure 12:
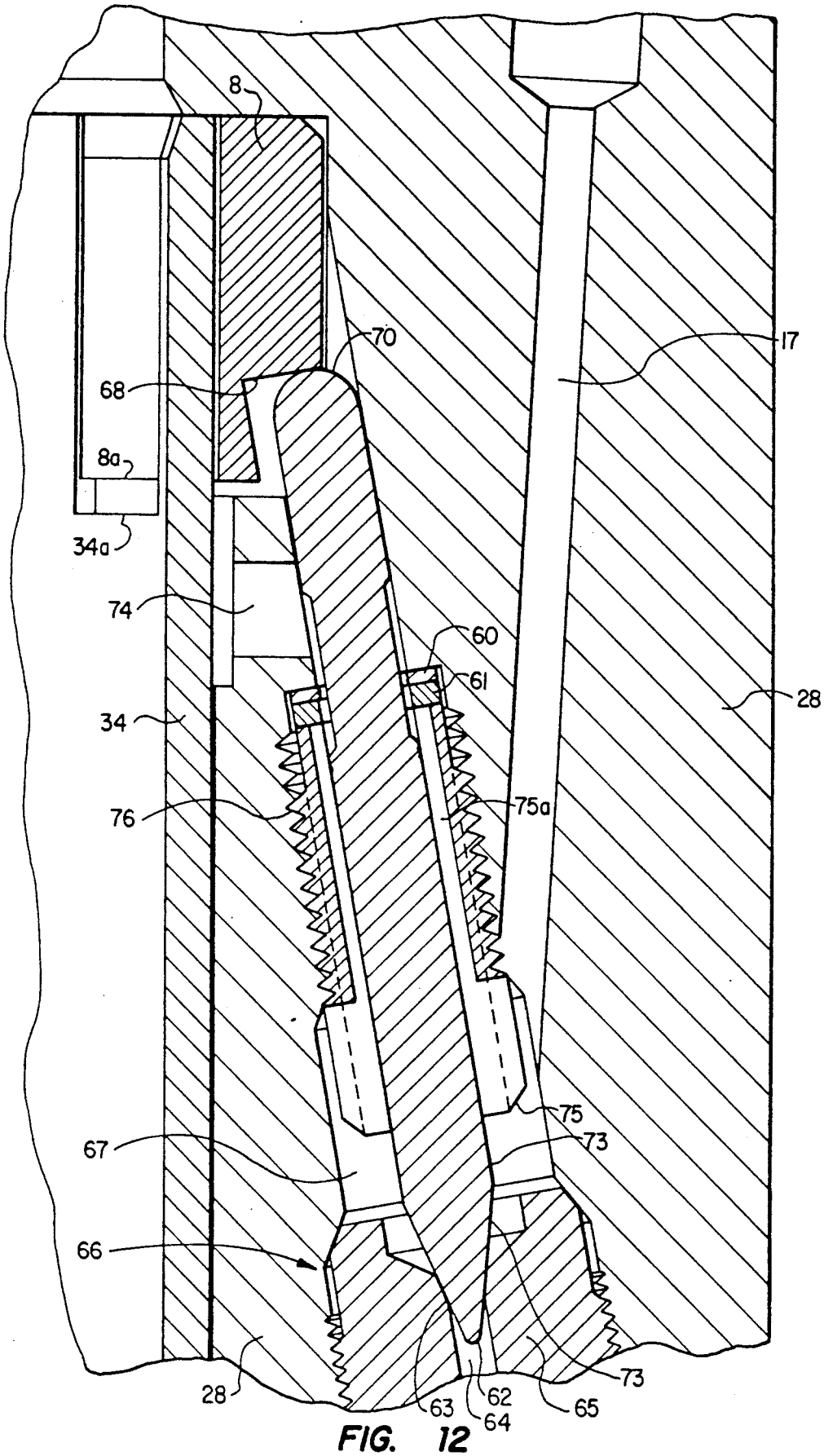
FIG. 12 is an enlarged cross sectional view of the means for closing communication between the first control line and safety valve control line in the position open to the insert safety valve within the landing nipple.

This position is illustrated in FIG. 12 where the communication between control line 12 and the SCSSV 45 is open and the control fluid is allowed access to an insert subsurface safety valve. Thus, after full rotation has been achieved, the control fluid path is as follows: the control fluid flows within control line 12, into bore 17, through slots 75*a* toward sheared flange 60, through aperture 74 to the insert subsurface safety valve. Valve poppet 73 has been pushed further into bore 64 so that tip 62 is inside internal bore 64 and the slanted edge of poppet 73 contacts and forms a metal to metal (MTM) liquid and gas tight seal against seat 63 of fitting adapter 65. Fitting adapter 65 may be connected to any suitable tubing connection fitting 55. After valve poppet 73 is seated, communication between bore 17 and internal bore 64 is blocked so that control fluid can no longer pass through internal bore 64 of fitting adapter 65. The landing nipple of the present invention thus acts as a control line fluid redirection nipple in that the control fluid is redirected from entering the downhole surface controlled subsurface safety valve and toward entering an insert subsurface safety valve instead Referring to FIG. 4, the surface of cam sleeve 8 is shown angled in such a way so as to, when rotated, push poppet 73 into internal bore 64 of fitting adapter 65 to form the metal to metal liquid and gas tight seal against seat 63 of fitting adapter 65.

Figure 8:
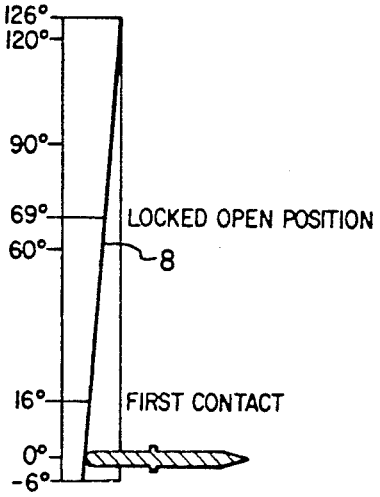
FIG. 8 shows the cam sleeve rotation angles needed for first contact and the locked open position.

FIG. 8 shows cam sleeve 8 as angled for this invention. The 0 degrees mark on cam sleeve 8 denotes when cam sleeve 8 is in its initial position so that control line 12 is open to the SCSSV. As cam sleeve 8 is rotated, the distance between poppet 73 and cam sleeve 8 begins to decrease as cam sleeve 8 approaches poppet 73. At approximately 16 degrees, the first contact between cam sleeve 8 and poppet 73 is made. At approximately 60 degrees, the line to the SCSSV is closed and the line to the insert safety valve is open. At approximately 69 degrees, the maximum required rotation is achieved to place cam sleeve surface 68 tightly against poppet 73 to close off communication between control line 12 and the SCSSV. Shearable flange 60 is severed at about 16 to 21 degrees of rotation.

Figure 6:
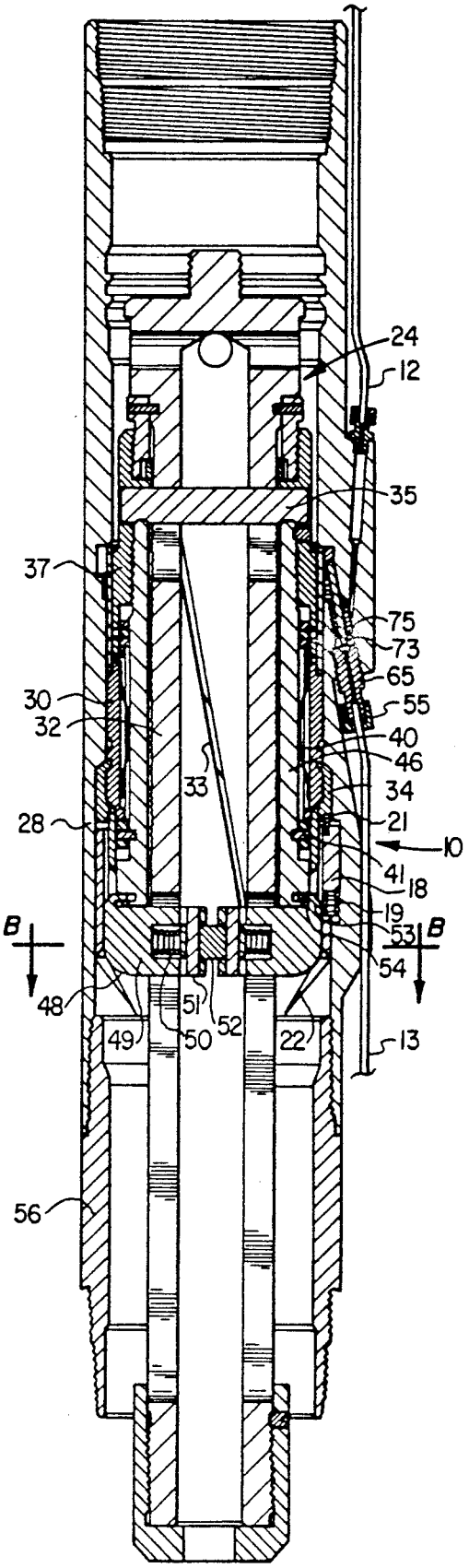
FIG. 6 is an elevational view in cross section of the landing nipple of the invention with a rotary shifter in place in its unextended position.

FIG. 6 shows landing nipple 10 with rotary shifter assembly 24 in place in the non-extended position. Rotary shifter 24 is preferably run below landing nipple 10 and then picked up or pulled up through it. The top of keys 30 are preferably pointed so that keys 30 will engage in orienting slots 22 in the lower end of guide shoe 16 and be directed into slots 26 and extended slots 27 in order to rotate sleeve 34. Because the entire shifter 24 can rotate, keys 30 and cross pin 35 are rotated into alignment with slots 26 and extended slots 27 of rotary sleeve 34. The upward facing square shoulders of keys 30 engage against the downward facing square shoulder of sleeve 34.

Figure 10:
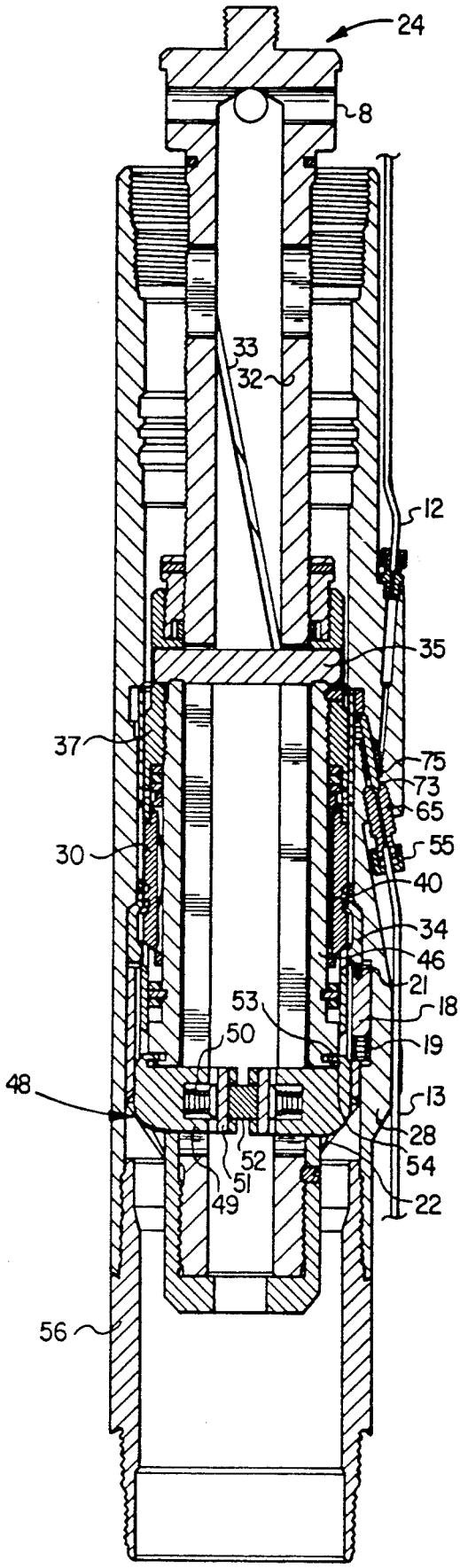
FIG. 10 is an elevational view in cross section of the landing nipple with rotary shifter in place in its fully extended position.

FIG. 10 shows landing nipple 10 with rotary shifter assembly 24 in its fully extended position A travel means, preferably rotary cross pin 35, passes through inner mandrel 32. Cross pin 35 passes through the upper end of the straight portion of slots 33, and pin 35 rotates as pin 35 travels along the curved portion of groove or slots 33, causing outer mandrel 38 to rotate. Key retainer housing 37 is secured to rotary cross pin 35 so that housing 37 will turn when rotary pin 35 turns. Inner mandrel 32 of rotary shifter assembly 24 and keys 30 are designed to turn when rotary pin 35 turns. Preferably, rotary sleeve 34 is rotated by applying sufficient upward force on shifter 24 to cause surface 68 of cam sleeve 8 to move toward poppet 73 and flange 60 to shear so as to force poppet 73 into internal bore 64 of fitting adapter 65 to form a MTM seal against seat 63, although a downward force could be used instead.

Rotary shifter assembly 24 is provided with a diametrically retractable means for prevention of rotation of inner mandrel 32 through which inner mandrel 32 can slide and which allows rotation of outer mandrel 38 and cross pin 35. Preferably, this means is a lug sub assembly 48 which comprises lugs 49 retained by connector 52 and pins 51. Springs 50 allow lugs 49 to retract and compress in order to pass through honed bores and other restrictions. Lugs 49 are provided with groove 54 and ears 53 which releasably fit in a groove in shear sleeve 46 to expandably secure lug sub assembly to shear sleeve 46.

Rotatable outer mandrel means 38 for releasably engaging a desired rotatable means of a piece of equipment preferably comprises a retractable means for releasably engaging a desired rotatable means of a piece of equipment. The retractable means preferably comprises at least one key 30 and spring 40 in a key retainer housing 37 for releasably engaging a desired rotatable means of a piece of equipment. Leaf spring 40 provides an outward force on keys 30 to maintain keys 30 in the protected position during rotation.

Rotatable outer mandrel means 38 also preferably includes shear sleeve 46 which is contiguous to inner mandrel 32 and the retractable means.

Figure 9:
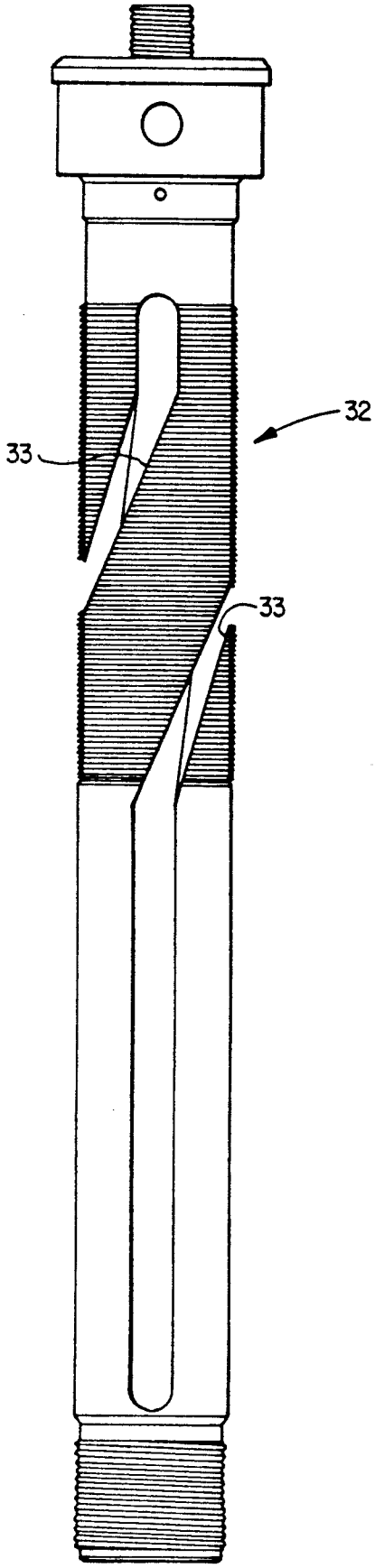
FIG. 9 is an elevational view of the inner mandrel of the rotary shifter showing the curved grooves in the inner mandrel.

Referring to FIG. 9, inner mandrel 32 is shown with two "J" slots approximately 180 degrees apart, and represents the preferred configuration for the inner mandrel. Inner mandrel 32 should have at least one at least partially curved groove or slot along the longitudinal axis of inner mandrel 32. Preferably, slots 33 form an inclined plane relative to the longitudinal axis of inner mandrel 32 and are helical or spiral in form.

Figure 7:
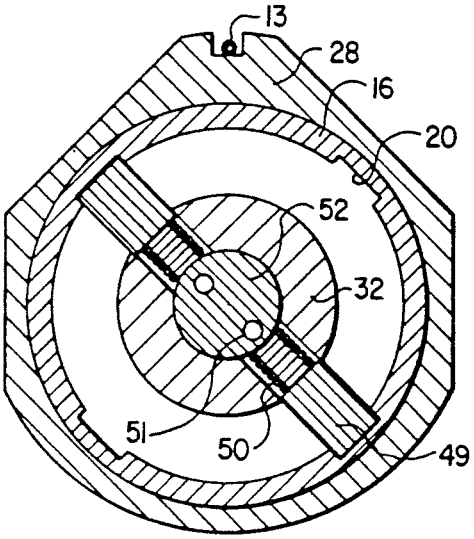
FIG. 7 is a cross sectional view of the landing nipple of the invention with rotary shifter in place taken along line B—B of FIG. 6.

FIG. 7 shows a cross-sectional view of FIG. 6 taken along line B—B. Lugs 49 are retained by connector 52 and pins 51. Springs 50 allow lugs 49 to retract and compress.

Figure 11A:
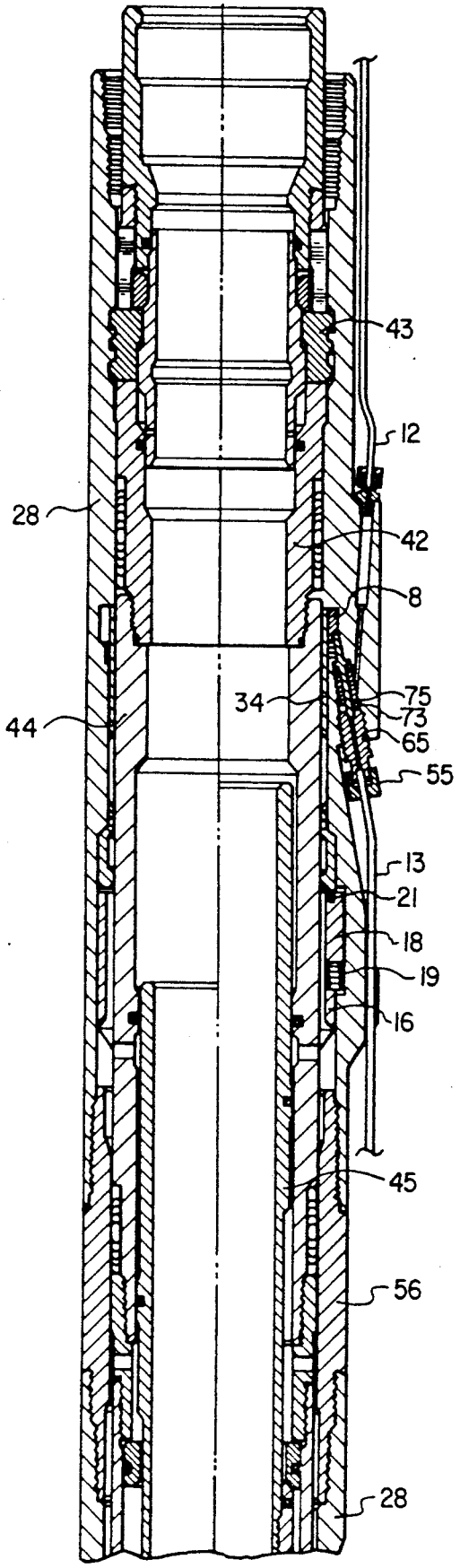
FIGS. 11A–11B are elevational views in cross section of the landing nipple of the invention with insert safety valve and lock mandrel in place.
Figure 11B:
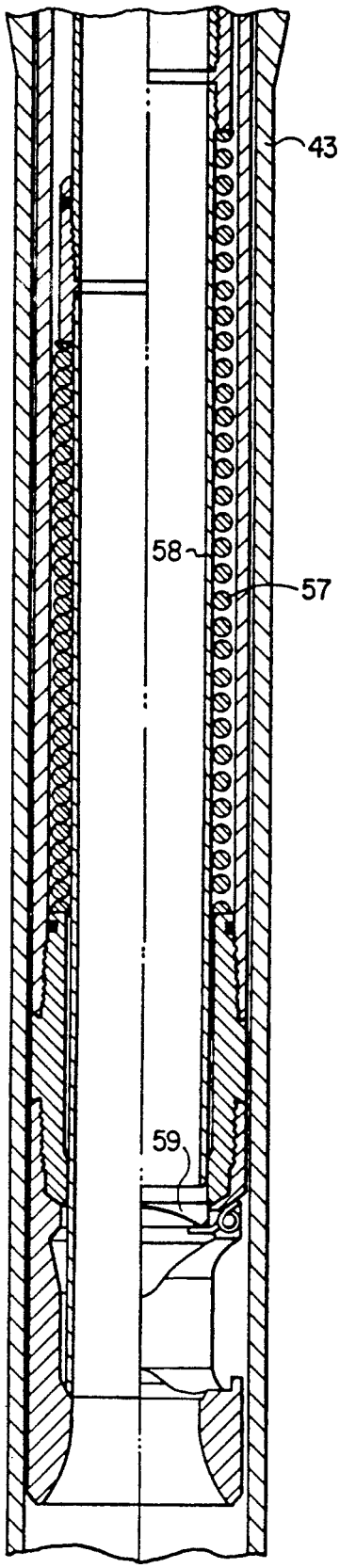

FIGS. 11A and 11B show landing nipple 10 with insert safety valve 45 and lock mandrel 42 installed. Lock mandrel key 43 is utilized to hold lock mandrel 42 in the desired position.

This invention also comprises a method of closing communication within landing nipple 10 between a first control line 12 and a safety valve control line 13 and opening communication between first control line 12 and insert safety valve 45 in the housing of landing nipple 10, which comprises the steps of first placing a means for rotation, preferably rotary shifter assembly 24, within nipple profile sub 28 and rotary member, preferably rotary sleeve 34, and then rotating the rotary member an amount sufficient to cause a means for closing communication between surface control line 12 and safety valve control line 13, preferably poppet pin 73 and cam sleeve 8, within a bore in the housing of landing nipple 10 to move in such a way so as to form a metal to metal seal with a means for connecting first control line 12 and safety valve control line 13 so as to open communication between first control line 12 and insert safety valve 45. The means for rotation may be placed through a means for guiding rotary shifter 24 into engagement with the rotary member.

Other alternatives will be obvious to one of ordinary skill in the art.

I claim:

1. A safety valve landing nipple comprising:
a nipple profile sub,
a landing nipple housing connected to said nipple profile sub,
a rotary member positioned inside said landing nipple housing, wherein said rotary member contains a means for engagement by a means for rotating said rotary member,
a bore in said landing nipple housing to which is connected a first control line on one end and a safety valve control line on the other end; and
a means responsive to rotation of said rotary member for closing communication in said bore between said first control line and said safety valve control line so that communication between said first control line and an insert safety valve in said landing nipple housing is achieved.

2. The safety valve landing nipple of claim wherein said rotary member is a rotary sleeve.

3. The safety valve landing nipple of claim 1, wherein said means for engagement in said rotary member is at least one slot in said rotary member for engagement by said means for rotating said rotary member.

4. The safety valve landing nipple of claim 1, wherein said means for rotating said rotary member is a rotary shifter with one or more keys for engagement in said means for engagement of said rotary member.

5. The safety valve landing nipple of claim 1, wherein said rotary member is a rotary sleeve which contains a plurality of slots therein.

6. A safety valve landing nipple comprising:
a nipple profile sub,
a landing nipple housing connected to said nipple profile sub,
a rotary sleeve positioned inside said landing nipple housing, wherein said rotary sleeve contains at least one slot therein for engagement by one or more keys of a rotary shifter,
a bore in said landing nipple housing to which is connected a first control line on one end and a safety valve control line on the other end; and
a means responsive to rotation of said rotary member for closing communication in said bore between said first control lien and said safety valve control line so that communication between said first control line and an inert safety valve in said landing nipple housing is achieved.

7. The safety valve landing nipple of claim 6, wherein said rotary sleeve contains a plurality of slots therein for engagement by one or more keys of said rotary shifter.

8. A safety valve landing nipple comprising:
a nipple profile sub,
a landing nipple housing connected to said nipple profile sub,
a rotary sleeve positioned inside said landing nipple housing, wherein said rotary sleeve contains at least one slot therein for engagement by one or more keys of a rotary shifter,
a bore in said landing nipple housing to which is connected a first control line on one end and a safety valve control line on the other end;
a pin positioned in said bore so that said pin can move in such a way so as to form a metal to metal seal with a means for connecting said first control line and said safety valve control line; and
a means for moving said pin to form said metal to metal seal.

9. The safety valve landing nipple of claim 8, wherein said rotary sleeve contains a plurality of slots therein for engagement by one or more keys of said rotary shifter.

10. The safety valve landing nipple of claim 8, wherein said means for connecting said first control line and said safety valve control line comprises a fitting adapter connected to a tubing connection fitting.

11. The safety valve landing nipple of claim 8, which further comprises a means for guiding said rotary shifter into engagement with said rotary sleeve.

12. The safety valve landing nipple of claim 8, wherein said pin is at least partially surrounded by a retainer.

13. The safety valve landing nipple of claim 8, wherein said means for moving said pin comprises a cam sleeve sufficiently attached to said rotary sleeve to rotate with said rotary sleeve, wherein said cam sleeve is sufficiently angled so as to contact and move said pin by the rotation of said rotary sleeve.

14. The safety valve landing nipple of claim 13, where said pin is at least partially surrounded by a retainer and said pin has a shearable extended portion, which when sheared, allows said pin to move in such a way so as to form a metal to metal seal with said means for connecting said first control line and said safety valve control line.

15. A safety valve landing nipple comprising:
a nipple profile sub,
a landing nipple housing connected to said nipple profile sub,
a rotary sleeve positioned inside said landing nipple housing, wherein said rotary sleeve contains a plurality of slots therein for engagement by one or more keys of a rotary shifter,
a means for guiding said rotary shifter into engagement with said rotary sleeve,
a bore in said landing nipple housing to which is connected a first control line on one end and a safety valve control line on the other end;
a pin with a shearable extended portion, where said pin is positioned in said bore so that when said extended portion is sheared, said pin can move in such a way so as to form a metal to metal seal with a means for connecting said first control line and said safety valve control line; and
a cam sleeve sufficiently attached to said rotary sleeve to rotate with said rotary sleeve, wherein said cam sleeve is sufficiently angled so as to contact and move said pin by the rotation of said rotary sleeve far enough to form said metal to metal seal, thereby closing communication in said bore in said landing nipple housing between said first control line and said safety vale control line.

16. The safety valve landing nipple of claim 15, wherein said pin is at least partially surrounded by a retainer.

17. The safety valve landing nipple of claim 15, wherein said means for connecting said first control line and said safety valve control line comprising a fitting adapter connected to a tubing connection fitting.

18. A method of closing communication within a landing nipple between a first control line and a safety valve control line and opening communication between said first control line and an insert safety valve in a housing of the landing nipple, which comprises the steps of:

placing a means for rotation within a nipple profile sub and rotary member; and rotating said rotary member an amount sufficient to cause a means for closing communication between said surface control line and said safety valve control line within a bore in said housing of said landing nipple to move in such a way so as to form a metal to metal seal with a means for connecting said first control line an d said safety valve control line so as to open communication between said first control line and said insert safety valve.

19. The method of claim 18, wherein said rotary member is a rotary sleeve.

20. The method of claim 18, wherein said means for rotation is a rotary shifter, wherein said rotary shifter contains at least one key and wherein each of said keys fits into a slot in said rotary member and remains in an expanded position in said slot until sufficient rotation is achieved.

21. The method of claim 18, wherein said rotary member is rotated by applying a sufficient force on said means for rotation so as to rotate said rotary member an amount sufficient to cause said means for closing communication between said surface control line and said safety valve control line to move in such a way so as to open communication between said first control, line and said insert safety valve.

22. The method of claim 18, wherein said rotary member is rotated an amount sufficient to cause a cam sleeve sufficiently attached to said rotary member to rotate within said rotary member so as to contact a pin positioned in a bore in the housing of said landing nipple, shear an extended portion of said pin and move said pin far enough to form a metal to metal seal, thereby closing communication in said bore in said landing nipple housing between said first control line and said safety valve control line.

23. The method of claim 18, wherein said means for rotation is first placed through a means for guiding said means for rotation into engagement with said rotary member.

24. The method of claim 18, wherein said means for rotation is first placed through guide sleeve to guide said means for rotation into engagement with said rotary member.

25. The method of claim 18, wherein a sufficient upward rotational force is applied to rotate said rotary member.

26. A method of closing communication within a landing nipple between a first control line and a safety valve control line and opening communication between said first control line and an insert safety valve in a housing of the landing nipple, which comprises the steps of:

placing a means for rotation within a nipple profile sub and rotary sleeve; and rotating said sleeve an amount sufficient to cause a means for closing communication between said surface control line and said safety valve control line within a bore in said housing of said landing nipple to move in such a way so as to form a metal to metal seal with a means for connecting said first control line and said safety valve control line so as to open communication between said first control line and said insert safety valve.

27. The method of claim 26, wherein said means for rotation is a rotary shifter, wherein said rotary shifter contains at least one key and wherein each of said keys fits into a slot in said sleeve and remains in an expanded position in said slot until sufficient rotation is achieved.

28. The method of claim 26, wherein said sleeve is rotated by applying a sufficient force on said means for rotation so as to rotate said sleeve an amount sufficient to cause said means for closing communication between said surface control line and said safety valve control line to move in such a way so as to open communication between said first control line and said insert safety valve.

29. The method of claim 26, wherein said sleeve is rotated an amount sufficient to cause a cam sleeve sufficiently attached to said sleeve to rotate with said sleeve so as to contact a pin positioned in a bore in the housing of said landing nipple, shear an extended portion of said pin and move said pin are enough to form a metal to metal seal, thereby closing communication in said bore in said landing nipple housing between said first control line and said safety valve control line.

30. The method of claim 26, wherein said means for rotation is first placed through a means for guiding said means for rotation into engagement with said rotary sleeve.

31. The method of claim 26, wherein said means for rotation is first placed through a guide sleeve to guide said means for rotation into engagement with said rotary sleeve.

32. The method of claim 26, wherein a sufficient upward rotational force is applied to rotate said sleeve.

33. A method of closing communication within a landing nipple between a first control line and a safety valve control line and opening communication between said first control line and an insert safety valve in a housing of said landing nipple, which comprises the steps of:

placing a rotary shifter within a nipple profile sub, means for guiding said shifter, and rotary sleeve, wherein said shifter contains at least one key and each of said keys fits into a slot in said rotary sleeve and remains in an expanded position in said slot until sufficient rotation is achieved; and applying a sufficient force on said shifter so as to rotate said sleeve an amount sufficient to cause a cam sleeve sufficiently attached to said sleeve to rotate with said sleeve so as to contact a pin positioned in a bore in the housing of said landing nipple, shear an extended portion of said pin and move said pin far enough to form a metal to metal seal, thereby closing communication in said bore in said landing nipple housing between said first control line and said safety valve control line and open communication between said first control line and said insert safety valve.

34. The method of claim 33, wherein said means for guiding said shifter is a guide shoe.

35. The method of claim 33, wherein a sufficient upward rotational force is applied to rotate said sleeve.

36. A method of closing communication within a landing nipple between a first control line and a safety valve control line and opening communication between said first control line and an insert safety valve in a housing of the landing nipple, which comprises the steps of:

placing a rotary shifter within a nipple profile sub, through a guide shoe and into engagement with a rotary sleeve, wherein said shifter contains at least one key and each of said keys fits into a slot in said rotary sleeve and remains in an expanded position in said slot until sufficient rotation is achieved, and applying a sufficient upward rotational force on said shifter so as to rotate said rotary sleeve an amount sufficient to cause a cam sleeve sufficiently attached to said rotary sleeve to rotate with said sleeve so as to contact a pin positioned in a bore in the housing of said landing nipple, shear an extended portion of said pin and move said pin far enough to form a metal to metal seal, thereby closing communication in said bore in said landing nipple housing between said first control line and said safety valve control level and open communication between said first control line and said insert safety valve.

37. A safety valve landing nipple comprising:

a nipple profile sub, a landing nipple housing connected to said profile sub, a rotary member positioned inside said landing nipple housing, wherein said rotary member contains a means for engagement by a means for rotating said rotary member, a bore in said landing nipple housing to which is connected a first control line on one end and a safety valve control line on the other end, a means responsive to rotation of said rotary member for closing communication in said bore between said first control line and said safety valve control line so that communication between said first control line and an insert safety valve in said landing nipple housing is achieved; and a means for guiding said means for rotating said rotary member to engagement with said rotary member.

38. The safety valve landing nipple of claim 37, which further comprises a guide shoe positioned within said nipple profile sub and contiguous to said rotary member for guiding said means for rotating into engagement with said rotary member.

39. The safety valve landing nipple of claim 37, wherein said means for closing communication in said bore between said first control line and said safety valve control line comprises (1) a pin positioned in said bore so that said pin can move in such a way so as to form a metal to metal seal with a means for connecting said first control line and said safety valve control line, and (2) a means for moving said pin to form said metal to metal seal.

40. The safety valve landing nipple of claim 39, wherein said means for moving said pin comprises a cam sleeve sufficiently attached to said rotary sleeve to rotate with said rotary sleeve, wherein said cam sleeve is sufficiently angled so as to contract and move said pin by the rotation of said rotary sleeve far enough to form said metal to metal seal, thereby closing communication in said bore in said landing nipple housing between said first control line and said safety valve control line.

41. The safety valve landing nipple of claim 39, wherein said means for moving said pin is a cam sleeve.

42. The safety valve landing nipple of claim 41, wherein said cam sleeve is attached to said rotary sleeve by at least one slot in said cam sleeve and at least one slot in said rotary sleeve.

43. The safety valve landing nipple of claim 39, wherein said pin is at least partially surrounded by a retainer and said pin has a shearable extended portion, which when sheared, allows said pin to move in such a way so as to form a metal to metal seal with said means for connecting said first control line and said safety valve control line.

44. A safety valve landing nipple comprising:

a nipple profile sub, a landing nipple housing connected to said nipple profile sub, a rotary sleeve positioned inside said landing nipple housing, wherein said rotary sleeve contains at least one slot therein for engagement by one or more keys of a rotary shifter, a bore in said landing nipple housing to which is connected a first control line on one end and a safety valve control line on the other end, a means responsive to rotation of said rotary member for closing communication in said bore between said first control line and said safety valve control line so that communication between said first control line and an insert safety valve in said landing nipple housing is achieved; and a means for guiding said rotary shifter to engagement with rotary sleeve.

45. The safety valve landing nipple of claim 44, wherein said means for closing communication in said bore between said first control line and said safety valve control line comprises (1) a pin positioned in said bore so that said pin can move in such a way so as to form a metal to metal seal with a means for connecting said first control line and said safety valve control line, and (2a means for moving said pin to form said metal to metal seal.

46. The safety valve landing nipple of claim 45, wherein said means for moving said pin comprises a cam sleeve sufficiently attached to said rotary sleeve to rotate with said rotary sleeve, wherein said cam sleeve is sufficiently angled so as to contact and move said pin by the rotation of said rotary sleeve far enough to form said metal to metal seal, thereby closing communication in said bore in said landing nipple housing between said first control line and said safety valve control line.

47. The safety valve landing nipple of claim 45, wherein said means for connecting said first control line and said safety valve control line comprises a fitting adapter connected to a tubing connection fitting.

48. The safety valve landing nipple of claim 46, wherein said cam sleeve is attached to said rotary sleeve by at least one slot in said cam sleeve and at least one slot in said rotary sleeve.

49. The safety valve landing nipple of claim 45, wherein said pin is at least partially surrounded by a retainer and said pin has a shearable extended portion, which when sheared, allows said pin to move in such a way so as to form a metal to metal seal with said means for connecting said first control line and said safety valve control line.

* * * * *